US006036184A

United States Patent [19]

Würthele

[11] Patent Number: 6,036,184

[45] Date of Patent: Mar. 14, 2000

[54] CLAMPING DEVICE, ESPECIALLY A MACHINE VICE

[75] Inventor: Adolf Würthele, Guntershausen, Switzerland

[73] Assignee: Gressel AG, Aadorf, Switzerland

[21] Appl. No.: 09/146,882

[22] Filed: Sep. 3, 1998

[30] Foreign Application Priority Data

Sep. 8, 1997 [DE] Germany ..... 297 16 104 U

[51] Int. Cl.[7] ..... B25B 1/20

[52] U.S. Cl. ..... 269/43; 269/154; 269/242; 269/285

[58] Field of Search ..... 269/43, 154, 242, 269/906, 208, 211, 282, 283, 285

[56] References Cited

U.S. PATENT DOCUMENTS

| | | | |
|---|---|---|---|
| 2,499,124 | 2/1950 | Zipp et al. . | |
| 4,330,113 | 5/1982 | Ferdinand et al. | 269/208 |
| 5,374,040 | 12/1994 | Lin | 269/43 |
| 5,442,844 | 8/1995 | Swann | 269/285 |
| 5,634,253 | 6/1997 | Swann . | |
| 5,762,326 | 6/1998 | Swann | 269/285 |

FOREIGN PATENT DOCUMENTS

| | | |
|---|---|---|
| 0 526 432 | 2/1993 | European Pat. Off. . |
| 3 925 718 | 2/1991 | Germany . |

OTHER PUBLICATIONS

"Fuehrung Sloahnschutz Spindelschutz Unfallschutz" of the Company FIPA GmbH Industrie Ausruestugen; pp. 3–7, 20 and 21 Feb. 1997.

"Fuehrungsbahnschutz Spindelschutz Unfallschutz" of the Company FIPA GmbH Industrie—Ausruestungen; pp. 3–7. 20 & 21 received Feb. 1997.

Company Brochure of HILMA–ROEMHELD GMBH, "Technische Daten/Zubehoer, Doppelspannsystem DS 125" [Technical data/accessories double clamping system DS 125], 4.3660, pp. 1–4 Issue Mar. 1996.

*Primary Examiner*—Robert C. Watson

*Attorney, Agent, or Firm*—Flynn, Thiel, Boutell & Tanis, P.C.

[57] ABSTRACT

A clamping device is described with a body, which has a substantially U-shaped cross-section, and at least one slide which can be shifted in the body by a screw spindle and which has at its upper side a plurality of fixing recesses arranged along the slide longitudinal direction with a mutual centre-to-centre spacing for selective engagement of a corresponding fixing projection of a jaw which can be repositioned and a plurality of threaded bores for fixing screws of the jaws. A plurality of cover sheets are provided on the upper side of the slide and they are slidably guided on the slide in its longitudinal direction and have a length which corresponds to the centre-to-centre spacing (pitch) of adjacent fixing recesses. The number of cover sheets corresponds to the number or centre-to-centre spacings (t) and the cover sheets can slide over the region of the currently unused fixing recesses and threaded bores.

18 Claims, 6 Drawing Sheets

CLAMPING DEVICE, ESPECIALLY A MACHINE VICE

FIELD OF THE INVENTION

This invention relates to a clamping device, especially a machine vice, with a body which has a substantially U-shaped cross-section and a support surface for a workpiece at the upper end of each of its upwardly projecting U arms, at least one slide which is mounted slidably in the body and can be moved by means of a screw spindle and comprises a plurality of fixing recesses in its upper side arranged along the longitudinal direction of the slide at a mutual centre-to-centre spacing for selective engagement with a corresponding fixing projection of a jaw which can be replaced and a plurality of threaded bores for fixing screws for the jaw, wherein the upper side of the slide is offset downwardly relative to the support surfaces of the body.

BACKGROUND OF THE INVENTION

In one such known clamping device (cf. company brochure of the company HILMA-RÖMHELD GMBH, D-57260 Hilchenbach (Germany), "Technische Daten/Zubehör, Doppelspannsystem DS 125" [Technical data/accessories double clamping system DS 125], 4.3660, page 1, issue March 1996 and DE 3 925 718 A1) two slides are mounted to move oppositely in the body. A central jaw is mounted in the central region of the body, so that two workpieces can be clamped at the same time. Since the maximum stroke of the slide or slides in such clamping devices is frequently less than 80 mm, the slide has several transverse grooves on its upper side, which are arranged at a centre-to-centre spacing (=pitch) of 40 mm for example. The jaw has a transverse projection matching the transverse groove and is attached to the slide by several fixing screws which engage in the threaded bores of the slide. The jaw can be removed from the slide by releasing the fixing screws and be fitted with its transverse projection in another transverse groove of the slide in order to adapt to different workpiece dimensions. However it is a disadvantage that the unused fixing recesses (transverse grooves) and threaded bores are then exposed. Swarf and cooling lubricant can penetrate into these pockets and can only be removed with difficulty and at cost of a lot of time. The swarf and cooling lubricant can mostly only be removed from the pockets with compressed air; however swarf and coolant are then blown in various directions and can settle again on places which have already been cleaned. There is also the danger of swarf and cooling lubricant being thrown back on to the operator, which can lead to injury to sight.

In order to protect the space of the body adjoining the slide in which the spindle is arranged from swarf, individual sheets, strips carried by the slide, bellows and the like are known. These devices are however not suitable for covering the fixing recesses and threaded bores present in the slide itself. These have previously been closed, if at all, by individual plugs, strips and the like, which however is a real nuisance and time-consuming. Moreover the loose parts can get lost.

Among the constructions cited in the previous paragraph, in which only the space of the body adjoining the slide is protected from swarf, there belongs the clamping device known from U.S. Pat. No. 5,634,253. In this known clamping device the body also has a U-shaped cross-section and two slides sliding in the body. A screw spindle is arranged between the U arms. In order to prevent the penetration of swarf into the space between the U arms of the body a cover plate is arranged on the upper side of the body. In one embodiment (FIGS. 16–18) this cover sheet has a rectangular opening. Grooves are provided in the longitudinal edges of this opening, in which two mutually overlapping cover sheets can slide in the direction of displacement of the slide. Each of these cover sheets is connected to one of the slides, so that it moves with the associated slide and protects the space between the U arms in each slide position from the penetration of swarf. However in this known clamping device there is no plurality of fixing recesses provided in either of the two slides and the jaws also cannot be repositioned relative to the corresponding slide in the slide longitudinal direction, so that the problem referred to above of contamination of fixing recesses does not even occur. Moreover the cover plate and the cover sheets also are only adapted to protect the body from swarf.

The like applies to the vice known from U.S. Pat. No. 2,499,124, in which a cover sheet is guided slidably in longitudinal grooves of the U arms of the body and protects the space between the U arms from penetration of swarf. The cover sheet is here also entrained by the movable slide. The jaw cannot be repositioned relative to the slide.

The latter also applies to the vice known from EP 0 526 432 A1, in which the movable jaw and the slide form a unit. In this vice the screw spindle is mounted in a sleeve, which has a flange. The flange can be brought for coarse adjustment of the sleeve into selective engagement with different recesses which are provided in the U arms of the body of U-shaped cross-section. Filler pieces of nylon can be fitted in the space between the U arms and are intended to prevent the penetration of swarf into the aforesaid space. However the filler pieces cannot prevent the penetration of swarf into the recesses referred to above.

Covers of various constructions, such as telescopic steel covers, roll covers and bellows for example are known from the brochure "Führungsbahnschutz, Spindelschutz, Unfallschutz" [Guideway protection, spindle protection, accident protection] of the company Fipa GmbH Industrie-Ausrüstungen, Ismaning, received February 1997, pp. 3 to 7 and 20 and 21.

SUMMARY OF THE INVENTION

The invention is therefore based on the object of designing a clamping device, especially a machine vice, of the kind initially referred to, such that the currently unused fixing recesses and threaded bores can be protected in a simple way against the penetration of swarf, cooling lubricant and other contaminants.

This is achieved according to the invention in that at least one cover sheet covering over the currently unused fixing recesses is provided on the upper side of the slide, which sheet is slidably guided on the slide in its longitudinal direction and has a length which corresponds to the centre-to-centre spacing (pitch) of adjacent fixing recesses, wherein the number of cover sheets corresponds to the number of centre-to-centre spacings and the cover sheet(s) can be moved over the region of the currently unused fixing recesses and threaded bores.

When for example three fixing recesses are arranged alongside each other on a slide in the longitudinal direction of the slide, two centre-to-centre spacings or pitches arise between these three fixing recesses. If the jaw is fitted with its fixing projection or its transverse bar in the middle fixing recess or transverse groove, the one cover sheet is pushed previously to the one end of the slide and the other cover sheet to the other end of the slide. Each of the two cover sheets then covers the fixing recesses and the threaded bores thereat. Swarf stays on the cover sheets and can easily be wiped off by hand after completion of the machining operation. Also the penetration of cooling lubricant into the fixing recesses and the threaded bores is largely prevented. Even if cooling lubricant does penetrate into these recesses, this does not matter, since the cooling lubricant is not then mixed with swarf. The swarf can also be blown off the smooth cover sheets with compressed air. Since there are no edges and pockets and the compressed air also cannot get to the fixing recesses and threaded bores covered by the cover sheets, there is no danger that swarf and cooling lubricant will spray back in an uncontrolled way into the room or on to the operator. The space between the jaws can be cleaned easily and in time saving manner at each workpiece change. Simply by keeping the workpiece beds clean there is a small risk of rejects. Since the cover sheets are guided on the slide, they can be lost neither when repositioning the jaw nor when dismounting the slide. The arrangement of the cover sheets on the upper side of the slide, which lies lower than the workpiece support surfaces, furthermore has the advantage that the cover sheets are recessed and cannot be damaged during fitting and removal of workpieces into or from the clamping device.

BRIEF DESCRIPTION OF THE DRAWINGS

The invention will be explained in more detail below, with reference to an embodiment shown in the drawings, in which.

DETAILED DESCRIPTION

Figure 2:
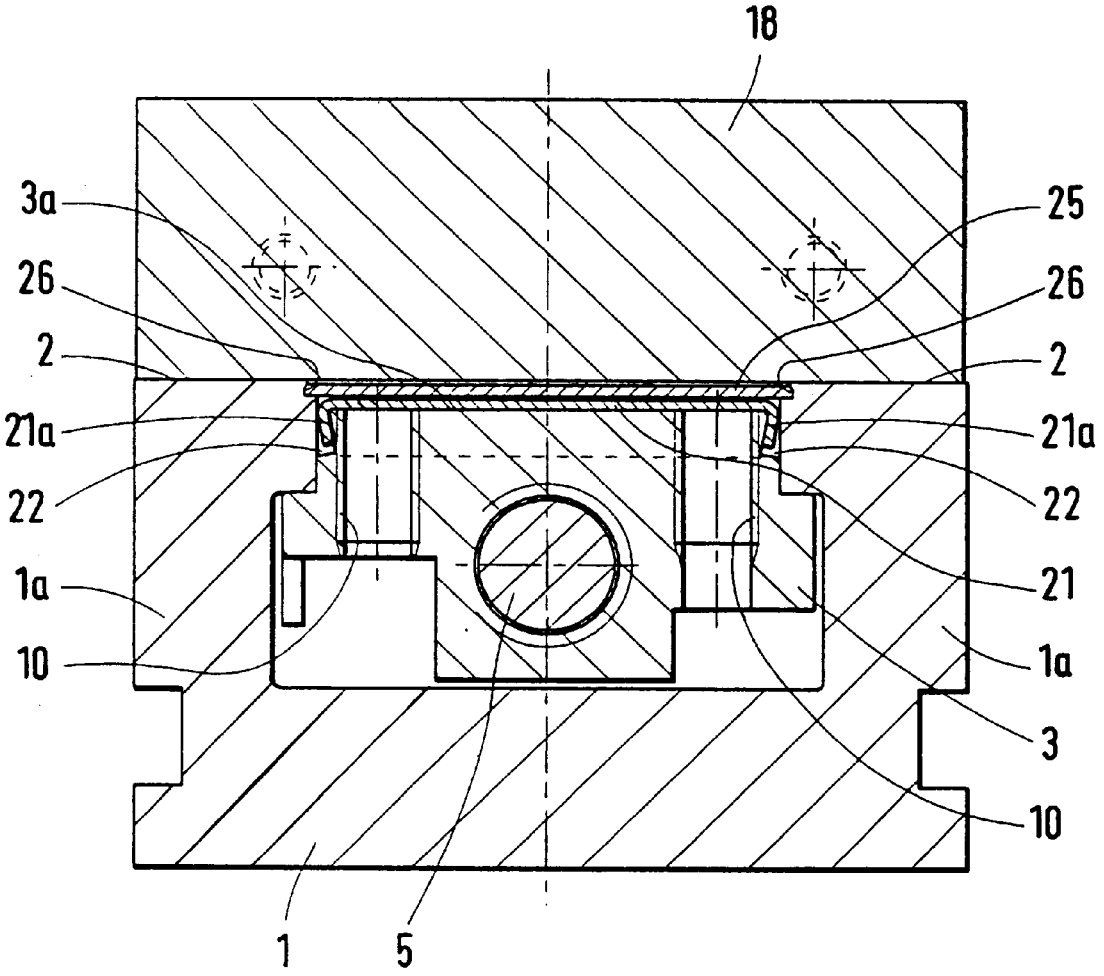
FIG. 2 is a cross-section of the clamping device according to the line II—II of FIG. 1*a,*
Figure 3:
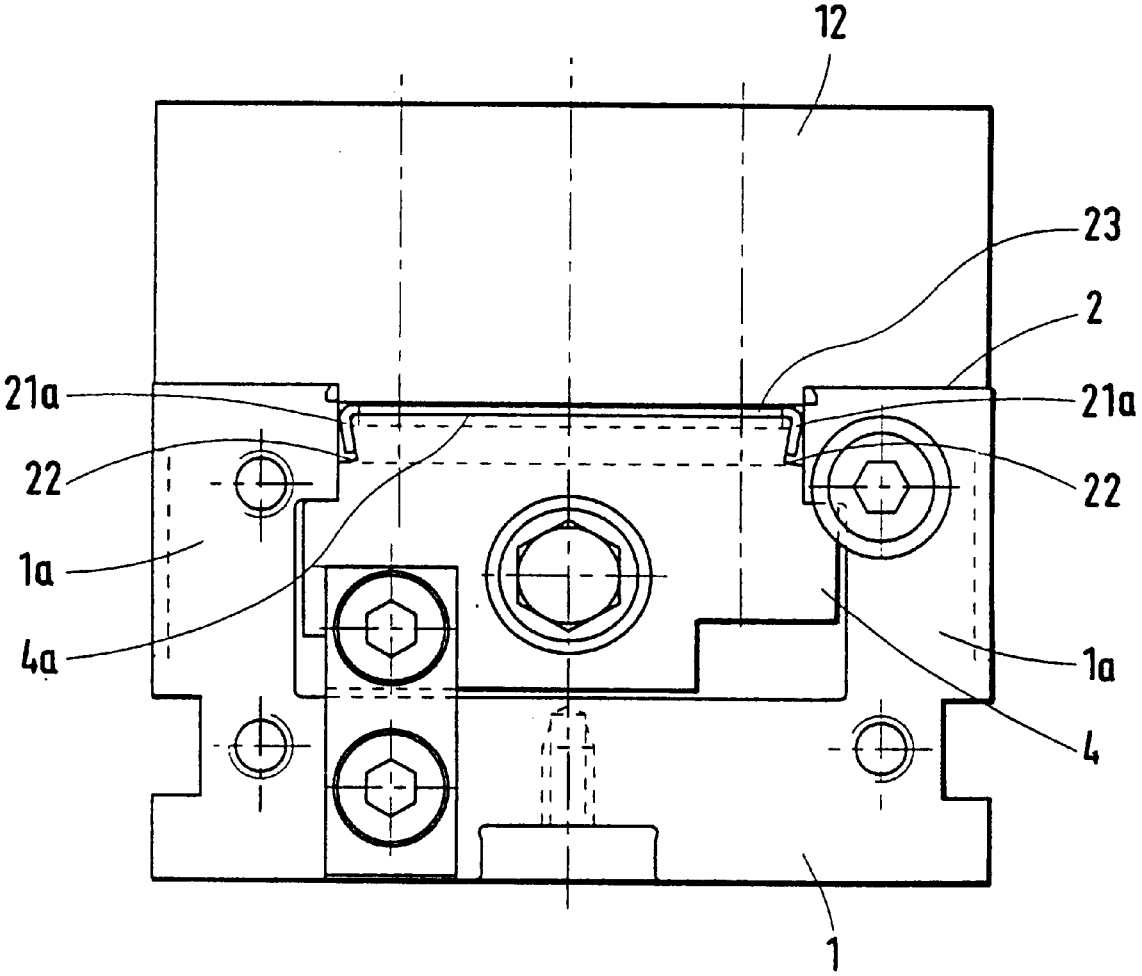
FIG. 3 is a front view of the clamping device in the direction III of FIG. 1*b,*
Figure 4:
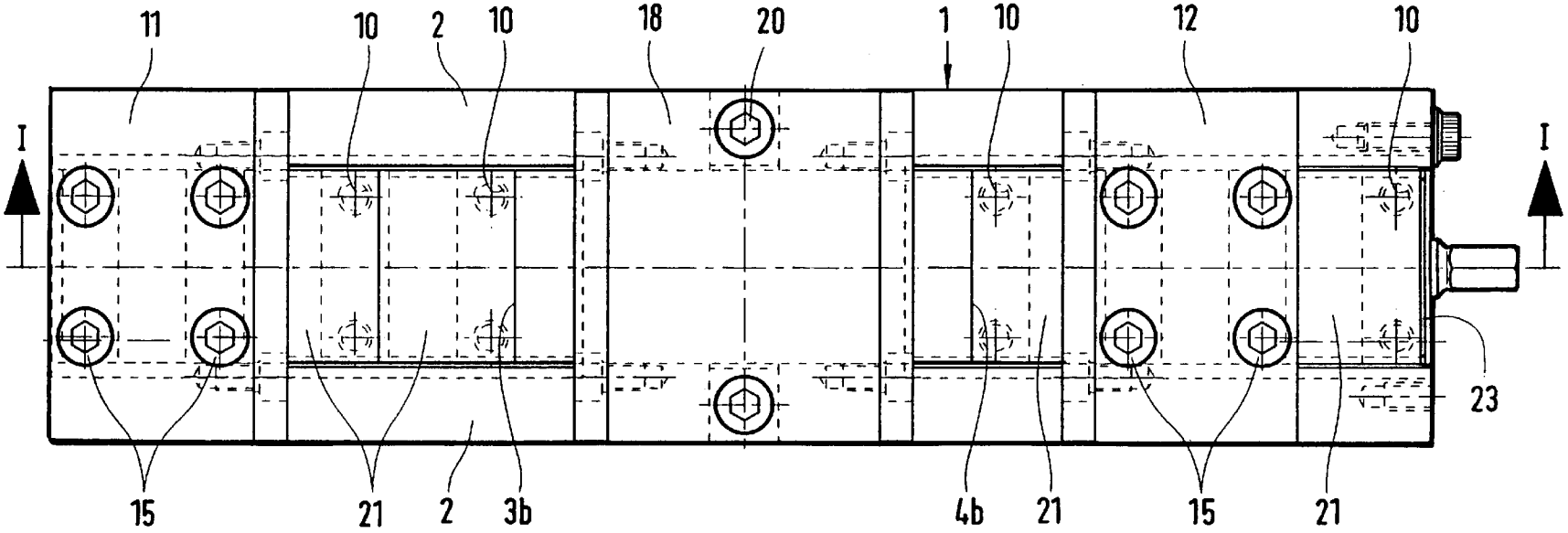
FIG. 4 is a plan view of the clamping device.

The invention is shown in the drawing in relation to a so-called double clamp, with which two workpieces can be clamped at the same time, or a large workpiece can be clamped after removing the central jaw. The body 1 has a substantially U-shaped cross-section, as can be seen especially from FIG. 2. The upwardly projecting U arms 1*a* of the body each have a support surface 2 for the workpiece at their upper end. Two slides 3, 4 are slidably guided in the body 1 in the longitudinal direction thereof The drive for these slides is effected by a screw spindle 5, whose threads 5*a*, 5*b* have opposite hands. The threads 5*a*, 5 engage in corresponding female threads 6, 7 of the slides 3 and 4 respectively. The upper side 3*a*, 4*a* of each of the two slides 3, 4 is offset downwardly relative to the support surfaces 2 of the body 1, as can be seen in particular from FIGS. 2 and 3.

Each of the two slides 3, 4 has three fixing recesses in the upper side in the form of transverse grooves 8*a*, 8*b*, 8*c* and 9*a*, 9*b*, 9*c* respectively. These fixing recesses or transverse grooves are arranged at a mutual centre-to-centre spacing (=pitch) t of 40 mm for example. The upper sides 3*a* and 4*a* are further provided with a plurality of threaded bores 10.

A detachable jaw 11, 12 is associated with each of these two slides 3, 4. Each of these jaws comprises a downwardly projecting fixing projection 13, 14 in the form of transverse bar. The fixing projections 13, 14 fit the fixing recesses 8*a*–8*c* and 9*a*–9*c*. Four fixing screws 15 are provided to fix each jaw 11, 12 on the corresponding slide 3, 4 and can be screwed into the threaded bores 10. Depending on the size of the workpiece the jaw 11 can be fitted with its fixing projection 13 selectively in the fixing recess 8*a*, 8*b* or 8*c* and then be attached to the slide 3 by means of the screws 15. The same applies to the jaw 12.

In the double clamp shown in the drawings, the body 1 further comprises a fixing device 16, 17 in its central region for a central jaw 18. The fixing device consists of a transverse groove provided in the two U arms 1*a* and threaded bores 17. The central jaw 18 is provided with a projection 19 in the region of its two longitudinal sides, each fitting the associated transverse groove 16 and the jaw can be attached to the U arms 1*a* by means of fixing screws 20.

Two cover sheets 21 are provided on the upper side of each slide 3, 4 and are slidably guided on the associated slide 3, 4 in its longitudinal direction. The length l of each of these cover sheets corresponds to the centre-to-centre spacing (pitch) t of the fixing recesses 8*a*–8*c* or 9*a*–9*c*. The number of cover sheets 21 provided on each slide corresponds to the number of pitches t. Since two pitches t are present with three fixing recesses 8*a*–8*c*, two cover sheets 21 are provided on the slide 3. The same applies in relation to the slide 4.

Each slide 3, 4 has an undercut longitudinal rebate 22 in the upper region of its two longitudinal sides for sidably guiding the cover sheet 21. A respective downwardly bent edge section 21*a* of the cover sheet 21 engages slidably in each of these longitudinal rebates 22. The two longitudinal rebates 22 of each slide 3, 4 and the edge sections 21*a* are advantageously of dovetail form. However, it would be conceivable to provide longitudinal grooves instead of this dovetail formation at the longitudinal sides of the slide, in which inwardly bent edge sections of the cover sheets then correspondingly engage. The design of the longitudinal rebates and the edge sections should prevent the cover sheets 21 lifting off the associated slides 3, 4 but allow longitudinal displacement of the cover sheets 21 relative to the associated slide 3, 4.

Furthermore it is advantageous if the displacement of the cover sheets is limited by stops in both directions of displacement. These stops are a step 3*b* on the right side and a strip 23 on the left side for the slide 3 in the illustrated embodiment. On the slide 4 the step 4*b* is at the left and the strip 23 at the right.

Figure 1:
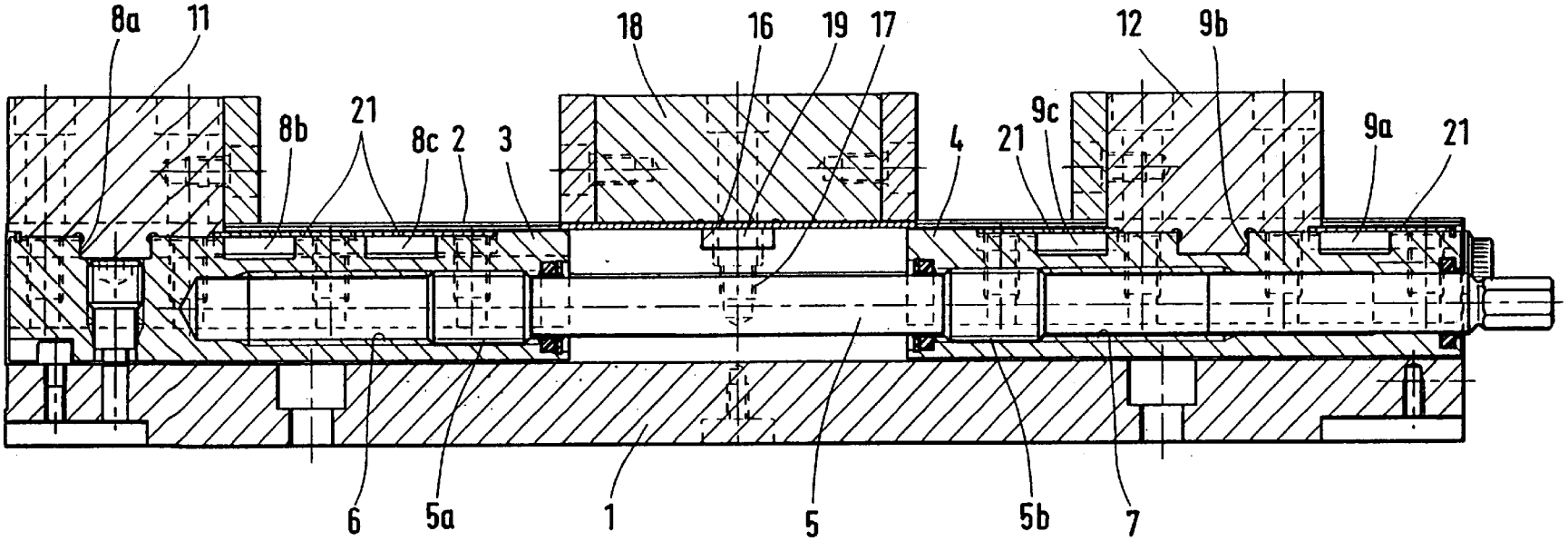
FIG. 1 is a longitudinal section of the clamping device according to the line I—I in FIG. 4.
Figure 1A:
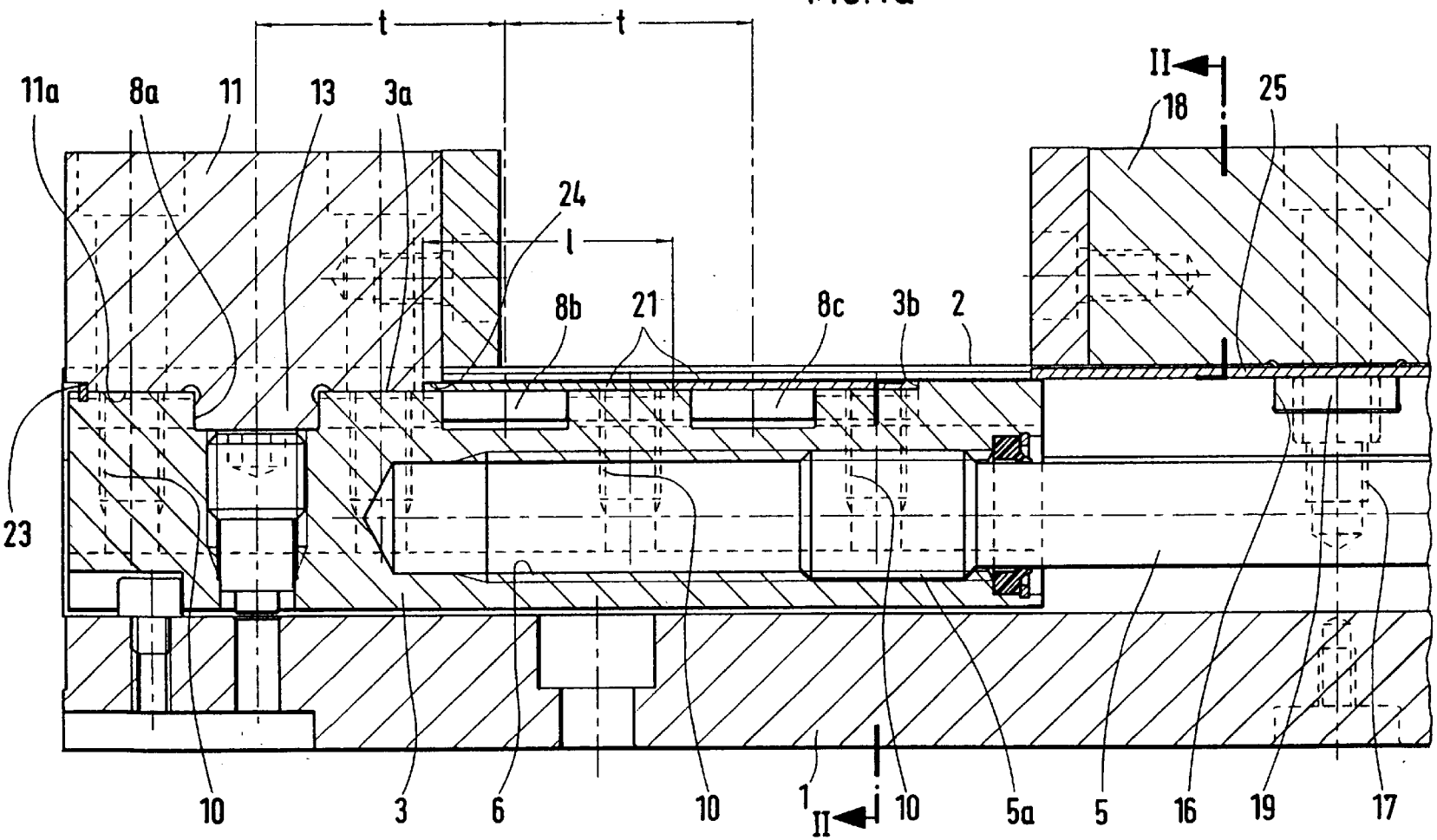
FIG. 1*a* shows the left half of this longitudinal section to a larger scale.

Moreover the jaws 11, 12 are each provided at their two transverse sides with a transverse rebate 24 in the region of their undersides, in which the transverse edge of the adjoining cover sheet 21 engages. The depth of this transverse rebate 24 and the positions of the stops 3*b*, 4*b* and 23 are so selected that the mutual spacing of the bottom of the transverse rebate 24 and the stops 3*b*, 4*b*, 23 with the jaws 11, 12 fitted corresponds in each case to the length l or a multiple thereof Before the jaw in question, e.g. the jaw 11 is attached to the slide 3 in correspondence with the size of the workpiece in question, the two cover sheets 21 are slid into the correct position. If for example the jaw 11 is to be fixed as shown in FIG. 1*a,* both cover sheets are pushed fully to the right, until the right cover sheet 21 bears on the step 3*b* and the left cover sheet 21 bears on the right. The jaw 11 is then fitted with its transverse bar 13 in the transverse groove 8*a*. Its underside 11*a* bears directly on the upper side 3*a* of the slide 3. The left edge of the left cover sheet 21 engages in the transverse rebate 24, so that both cover sheets 21 are now secured against longitudinal displacement. The jaw 11 is then attached to the slide 3 by four fixing screws 15. The cover sheets 21 cover the transverse grooves 8*b* and 8*c* and the threaded bores 10 in the slide 3 lying to the right of the jaw 11. Penetration of contaminants, especially of swarf, into the transverse grooves 8*b*, 8*c* and the unused threaded bores 10 is prevented in this manner.

The slide 3 is made of such length that it engages under the central jaw 18 in each of its clamping positions. Penetration of swarf into the space of the body 1 bounded by the two U arms 1*a* is also prevented in this way. The same applies in general terms to the second slide 4.

Figure 1B:
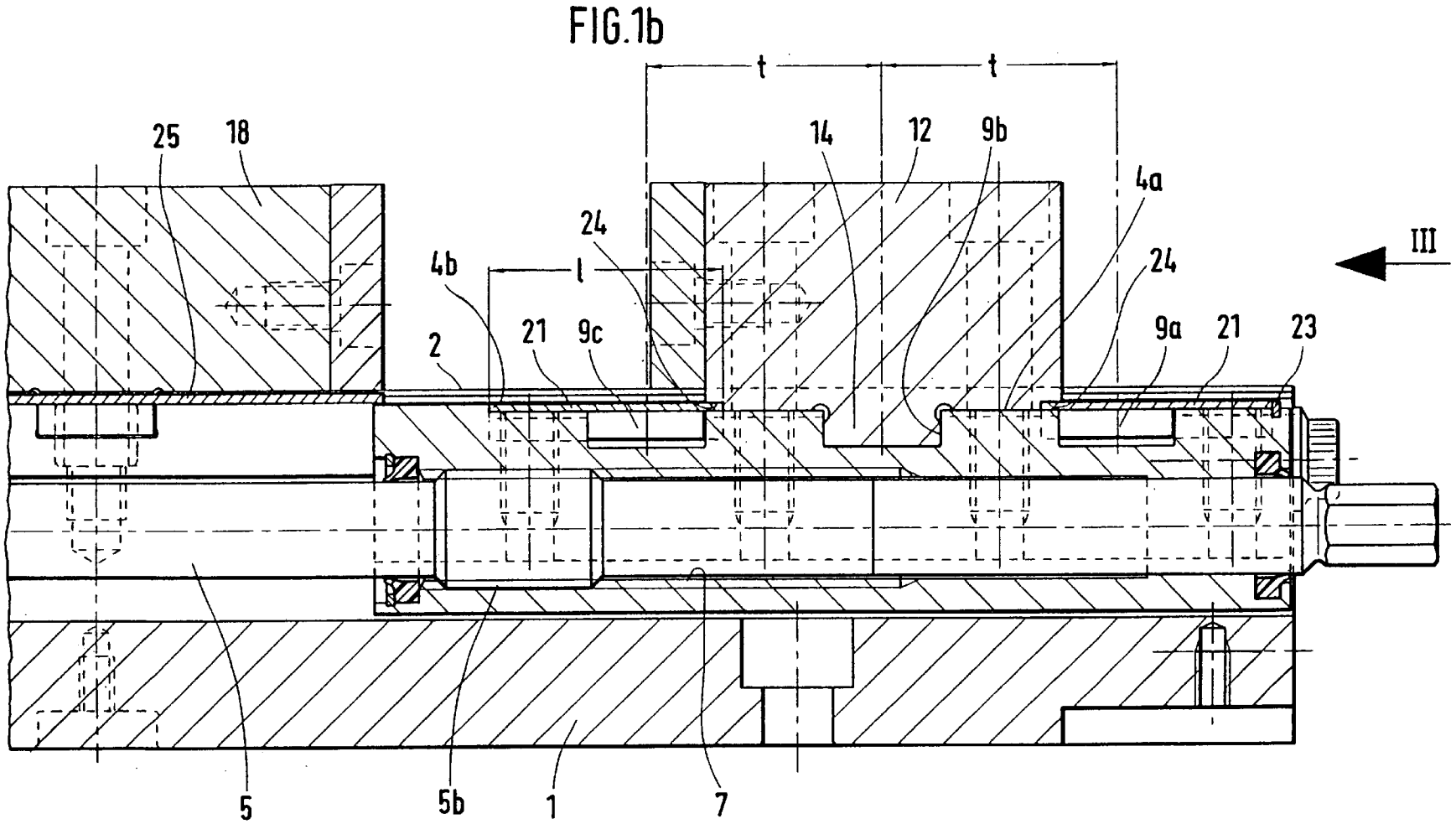
FIG. 1*b* shows the right half of this longitudinal section to a larger scale.

It can be seen from FIG. 1*b* that with engagement of the transverse bar 14 of the jaw 12 in the middle transverse groove 9*b*, one of the cover sheets 21 has to be pushed fully to the right, until it bears on the strip 23, and the other cover sheet wholly to the left, until it bears on the step 4*b*. Only then can the jaw 12 be attached to the slide 4.

The cover sheets 21 are advantageously made from stainless steel.

If now the central jaw 18 has to be removed from the body 1 to clamp larger workpieces, the space underneath the jaw 18 would be exposed and swarf could penetrate there. In order to prevent this a cover plate 25 is provided below the plane of the support surfaces 2, in the region of the fixing device 16, 17 between the upwardly projecting U arms 1*a*, as can be seen in particular from FIG. 2. The length of this cover plate 25 corresponds approximately to the length of the central jaw 18. The longitudinal edges of the cover plate 25 engage in grooves 26, which are formed in the side surfaces of the U arms 1*a* facing one another. As can further be seen from FIG. 2, the cover sheets 21 are arranged on the slides 3, 4 in a plane below the cover plate 25, so that they can be pushed under the cover plate 25 with corresponding further displacement of the respective slide 3. The grooves 26 can be undercut, so that the cover plate 25 cannot be released inadvertently from the body 1.

The design according to the invention can be used equally with clamping devices, especially machine vices, with only one movable slide and a fixed jaw.

I claim:

1. A clamping device comprises a body which has a substantially U-shaped cross-section and a support surface for a workpiece at an upper end of each of its upwardly projecting U arms, at least one slide which is mounted slidably in the body and movable by means of a screw spindle and comprises a plurality of fixing recesses in its upper side arranged along a longitudinal direction of the slide at a mutual centre-to-centre spacing, a jaw having a corresponding fixing projection for selective engagement with selected ones of the fixing recesses, the jaw including a plurality of threaded bores for fixing screws to the jaw, wherein an upper side of the slide is offset downwardly relative to the support surfaces of the body, wherein at least one cover sheet covering over the currently unused fixing recesses is provided on the upper side of the slide, said sheet being slidably guided on the slide in its longitudinal direction and having a length which corresponds to the centre-to-centre spacing of adjacent ones of the fixing recesses, wherein the number of cover sheets corresponds to the number of centre-to-centre spacings so that the at least one cover sheet is movable over the region of the currently unused ones of the fixing recesses and the threaded bores.

2. A device according to claim 1, wherein the path of displacement of the at least one cover sheet is limited by stops in both directions of displacement.

3. A device according to claim 1, wherein the slide includes an undercut longitudinal rebate in the upper region of each of its two longitudinal sides, in which downwardly bent edge sections of the at least one cover sheet slidably engage.

4. A device according to claim 3, wherein the two longitudinal rebates and the edge sections have a dovetail form.

5. A device according to claim 1, wherein the at least one cover sheet consists of stainless steel.

6. A device according to claim 1, wherein the jaw includes a transverse rebate at its two transverse sides in a region of its underside, in which a transverse edge of the adjoining cover sheet engages.

7. A device according to claim 1, wherein the at least one slide is of such a length to engage under a further jaw which is opposed to the jaw connected to the slide.

8. A device according to claim 1, wherein the slide comprises a first slide, and a second slide slidable opposite to the first slide, wherein the first and second slides are provided in the body and a fixing device is provided in a central region of the body for an additional removable central jaw, a cover plate is provided below the plane of the support surfaces in the region of the fixing device between the upwardly projecting U arms of the body, its length corresponding approximately to the length of the removable central jaw and its longitudinal edges engaging in grooves which are formed in the facing side surfaces of the U arms, and wherein the cover sheets on the first and second slides are arranged in a plane below the cover plate.

9. A clamping device comprising:

a body having a substantially U-shaped cross-section and support surfaces for a workpiece at upper ends of respective upwardly projecting U arms;

at least one slide mounted slidably to the body and movable by means of a screw spindle, said slide including a plurality of fixing recesses for selective engagement with a corresponding fixing projection of a jaw, wherein an upper side of the slide is offset downwardly relative to the support surfaces of the body; and at least one cover sheet provided on the upper side of the slide for covering currently unused ones of the fixing recesses, the sheet being slidably guided on the slide and having a length which corresponds to a pitch of adjacent ones of the fixing recesses;

wherein the number of cover sheets corresponds to a number of center-to-center spacings, the at least one cover sheet capable of moving over a region of the currently unused ones of the fixing recesses and the threaded bores.

10. A device according to claim 9, said device including stops for limiting displacement of the at least one cover sheet.

11. A device according to claim 9, the slide including an undercut longitudinal rebate in an upper region of each of two longitudinal sides thereof, in which downwardly bent edge sections of the at least one cover sheet slidably engage the slide.

12. A device according to claim 11, wherein the two longitudinal rebates and the edge section have a dovetail form.

13. A device according to claim 9, wherein the at least one cover sheet comprises stainless steel.

14. A device according to claim 9, said device including a jaw that is repositionable and has a transverse rebate at two transverse sides in an underside of a region thereof, a transverse edge of the cover sheet engaging the transverse rebate of the jaw.

15. A clamping device comprising:

a body having a substantially U-shaped cross-section and support surfaces for a workpiece at upper ends of respective upwardly projecting U arms;

a first slide mounted slidably to the body and movable by means of a screw spindle, said first slide including a plurality of first fixing recesses for selective engagement with a corresponding fixing projection of a jaw and including threaded bores for fixing screws to a jaw, wherein an upper side of the slide is offset downwardly relative to the support surfaces of the body;

a second slide mounted slidably to the body, said second slide oppositely slidable with respect to said first slide;

at least one cover sheet provided on the upper side of the first slide for covering currently unused ones of the fixing recesses, the cover sheet being slidably guided on the slide and having a length which corresponds to center-to-center spacing of adjacent ones of the fixing recesses;

wherein the number of cover sheets corresponds to the number of the center-to-center spacings, the at least one cover sheet capable of moving over a region of the currently unused ones of the fixing recesses and the threaded bores.

16. A device according to claim 15, the device including stops for limiting displacement of the at least one cover sheet.

17. A device according to claim 15, the device including a fixing device in a central region of the body for supporting a removable central jaw.

18. A device according to claim 17, including a cover plate provided below the plane of the support surfaces in the central region of the fixing device and having a length corresponding approximately to the length of a removable central jaw.

* * * * *